United States Patent [19]

Pinter et al.

[11] Patent Number: 4,544,447

[45] Date of Patent: Oct. 1, 1985

[54] DEHYDRATION MACHINE FOR PULP, SLUDGES OR SIMILAR FIBROUS MATERIALS

[75] Inventors: Reinhard Pinter, Graz; Franz Petschauer, Lannach; Johann Sbaschnigg, Graz, all of Austria

[73] Assignee: Maschinenfabrik Andritz Actiengesellschaft, Graz-Andritz, Austria

[21] Appl. No.: 517,647

[22] Filed: Jul. 27, 1983

[30] Foreign Application Priority Data

Feb. 9, 1983 [AT] Austria ..... 436/83

[51] Int. Cl.[4] ..... D21F 1/00; B01D 33/04

[52] U.S. Cl. ..... 162/300; 162/305; 162/301; 162/331; 210/400; 210/401

[58] Field of Search ..... 162/300, 301, 305, 353, 162/331, 334, 308, 312, 336; 210/400, 401; 100/118

[56] References Cited

U.S. PATENT DOCUMENTS

| | | | |
|---|---|---|---|
| 1,875,075 | 8/1932 | Mason | 162/301 |
| 3,605,607 | 9/1971 | Gujer | 210/401 |
| 3,810,818 | 5/1974 | Arledter | 162/301 |
| 3,823,062 | 7/1974 | Ward et al. | 162/301 |
| 3,929,065 | 12/1975 | Csordas et al. | 162/301 |
| 4,124,441 | 11/1978 | Nykopp | 162/301 |
| 4,220,502 | 9/1980 | Lavänen | 162/301 |
| 4,416,730 | 11/1983 | Schiel | 162/300 |

FOREIGN PATENT DOCUMENTS

| | | | |
|---|---|---|---|
| 1964950 | 7/1971 | Fed. Rep. of Germany | 210/400 |
| 2751849 | 5/1979 | Fed. Rep. of Germany | 210/401 |
| 3034612 | 3/1982 | Fed. Rep. of Germany | 210/400 |
| 35098 | 3/1983 | Japan | 100/118 |
| WO82/02686 | 8/1982 | PCT Int'l Appl. | 100/118 |
| 408527 | 4/1934 | United Kingdom | 162/353 |
| 518066 | 2/1940 | United Kingdom | 162/353 |

*Primary Examiner*—S. Leon Bashore
*Assistant Examiner*—K. M. Hastings
*Attorney, Agent, or Firm*—Frost & Jacobs

[57] ABSTRACT

The invention relates to an improvement in a dehydration machine for wood pulp, sludges, or similar fibrous material, composed of a lower strainer operating as a support strainer and an upper strainer operating as the cover strainer, which loop support and reversing rolls and are adapted to pass jointly with the material to be dehydrated coming from a material feed through a wedging section and through pairs of pressing rolls in a pressing section, the improvement comprising a laterally sealed wedging section arranged substantially vertically or at an incline, followed directly by a reversal means provided with a lateral seal, and the pressing section including a group of rolls which at the beginning contains a pair of first and second pressing rolls mounted next to each other, with a pressing roll contacting the second pressing roll.

5 Claims, 7 Drawing Figures

DEHYDRATION MACHINE FOR PULP, SLUDGES OR SIMILAR FIBROUS MATERIALS

Figure 1:
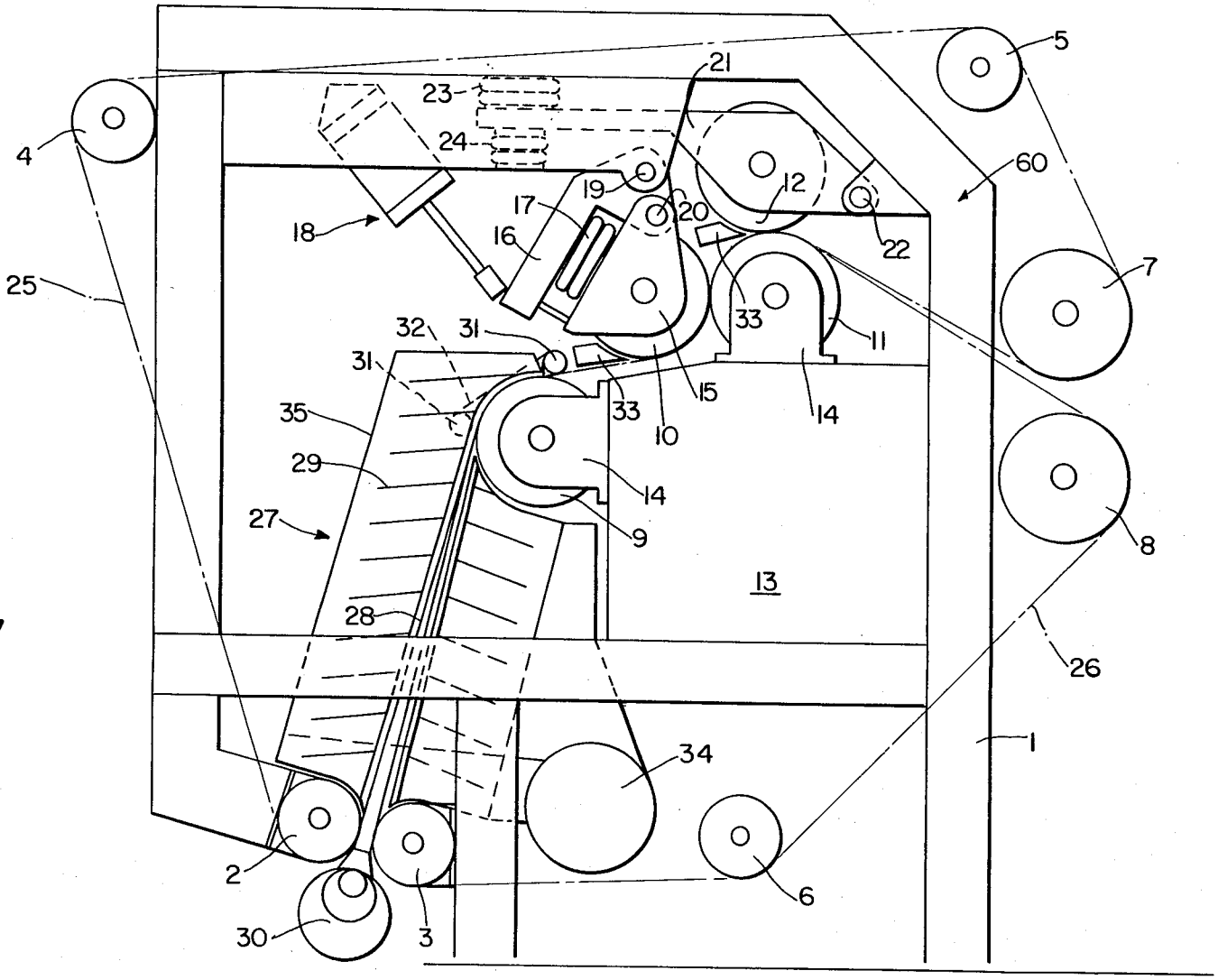

This invention relates to a dehydration machine for pulp, sludges or similar fibrous materials, composed of a lower sieve acting as a support sieve and of an upper sieve operating as a cover sieve, which sieves revolve about support and reversing rolls and are guided jointly with the material to be dehydrated, coming from the material intake, through a wedging section and a pressing roll section.

The purpose of such machines is to effectively dehydrate fibrous material, with especially short dehydration paths for a constant dehydration efficiency being desired in order to achieve as compact a design as possible.

German Offenlegungsschrift No. 2,903,501, discloses a two-strainer track molding section for a paper machine which similarly evinces a compact design. In this case also, there is a lower strainer belt looping around a number of rolls and a further upper strainer belt guided in the same manner, the material to be dehydrated being guided between the ascendingly contacting track sections. It is especially characteristic in this regard that the wedging section be directed upwardly, preferably at an angle of 45°, with an open breast table being used to support the support sieve. A reversing roll is provided at the end of the wedging section and contains a suction means. A water drain straining device is mounted in the upper part of the reversing roll, wherein the water centrifugally forced out of the track is evacuated.

In addition to an intensive use of vacuum, this type of dehydration machine furthermore requires that the band of material be at most of a relatively low density, in the range from 40 to 80 g/m$^2$. Inherently, the speed then will be relatively high so that the pressed out water can be centrifugally evacuated. To this end, a band speed of about 100 m/min is required. If, however, larger band thicknesses must be dehydrated, which necessarily must proceed at a lower rate, then this kind of dehydration machine no longer can be used.

Based on this state of the art, it is the object of the present invention to provide a dehydration machine also designed in principle as a double belt press of the same type, but which without resorting to vacuum will achieve better efficiency. Compactness is retained. This goal is met by the invention in that reversal takes place directly at a vertical or inclined wedging section which is mounted at an acute angle and with lateral sealing, the reversal means also being laterally sealed, and in that the pressing section comprises a group of rolls containing, firstly, a pair of rolls mounted next to each other and upon which adjoiningly rests a superposed pressing roll. To achieve compactness, another embodiment of the invention provides a setting system for the first pressing roll, whereby selectively areal compression with an ensuing pressing nip or two line compressions are made possible. This design allows high dehydrations at low operational costs.

Figure 3:
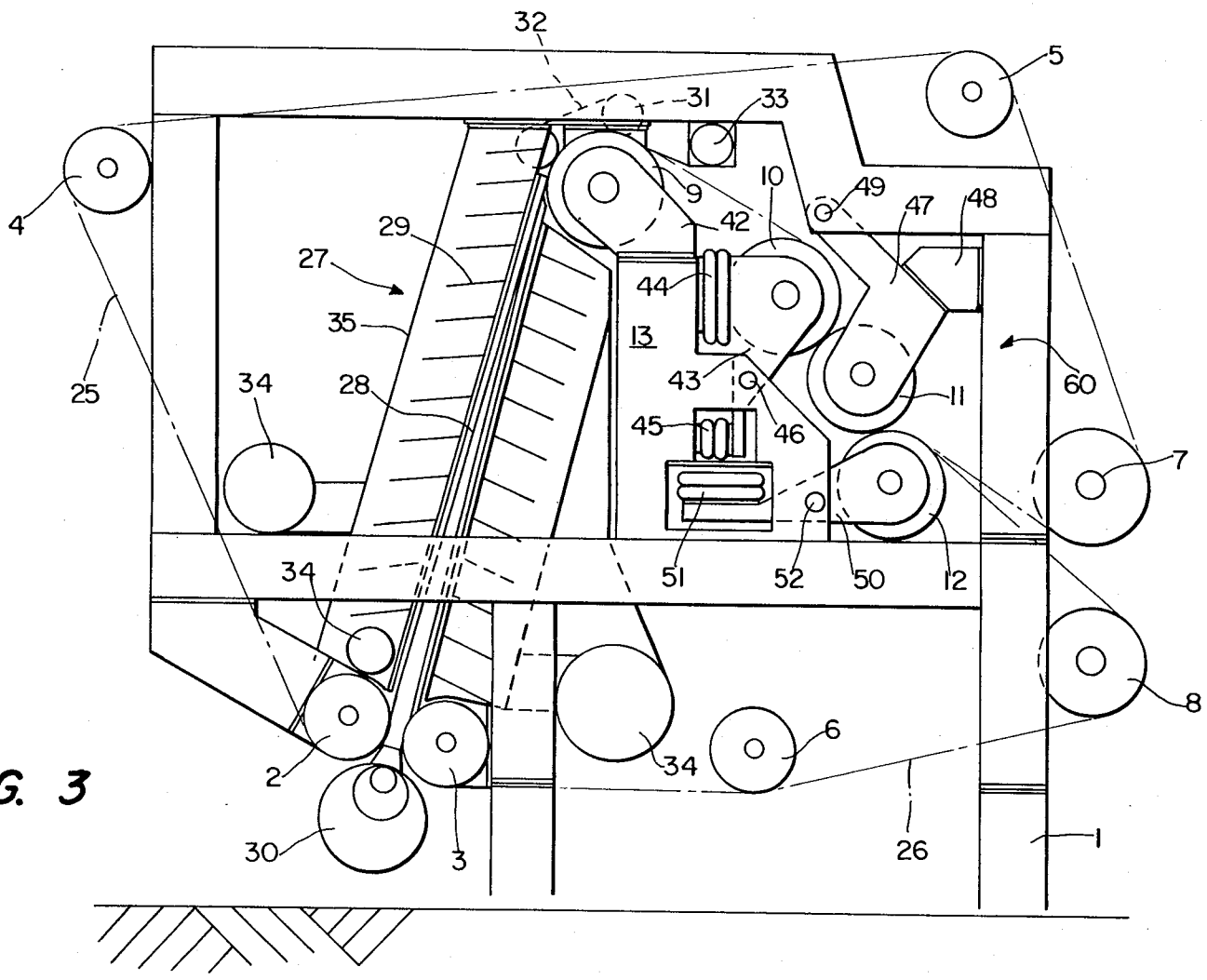
Figure 4:
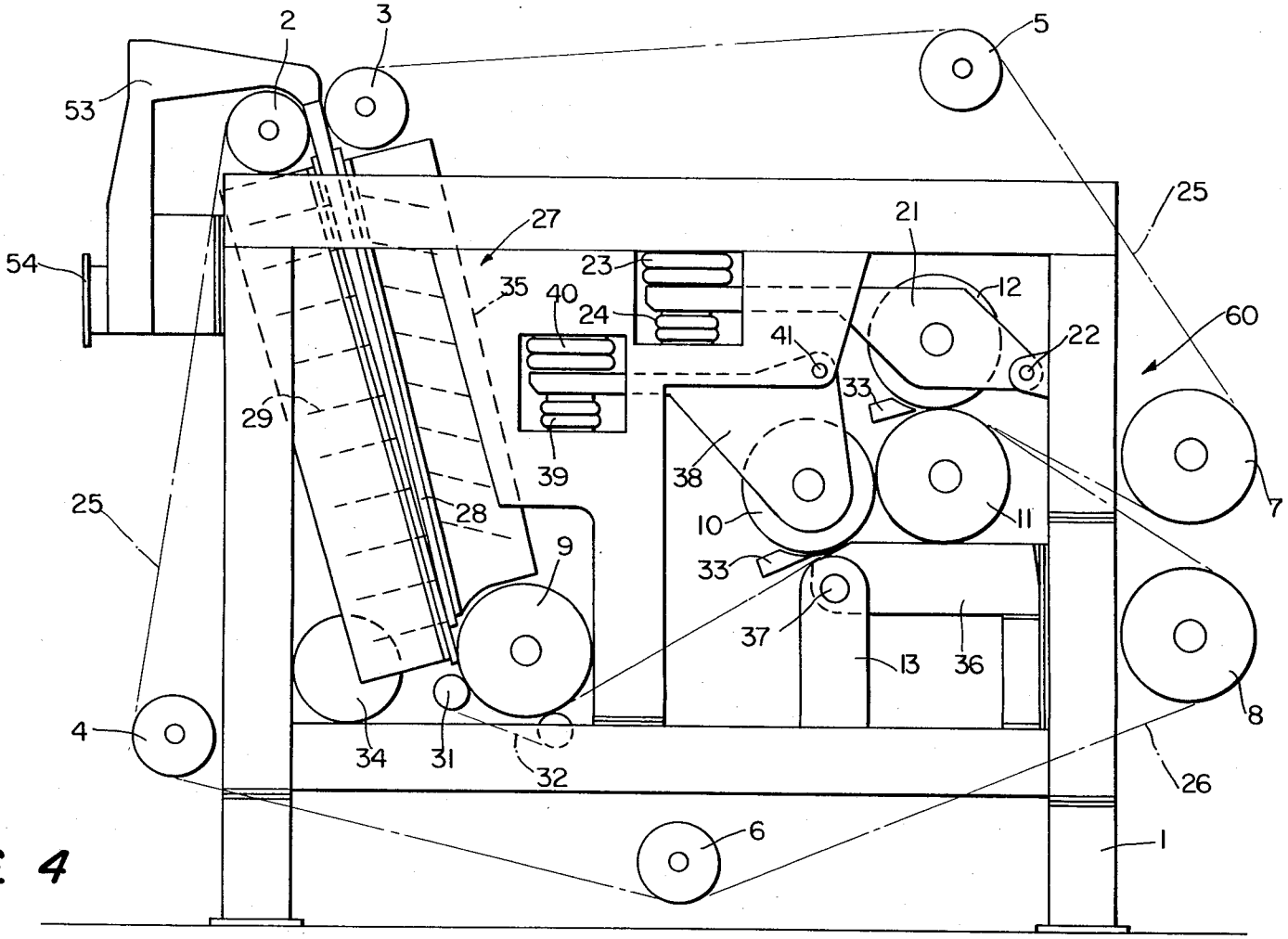
Figure 5:
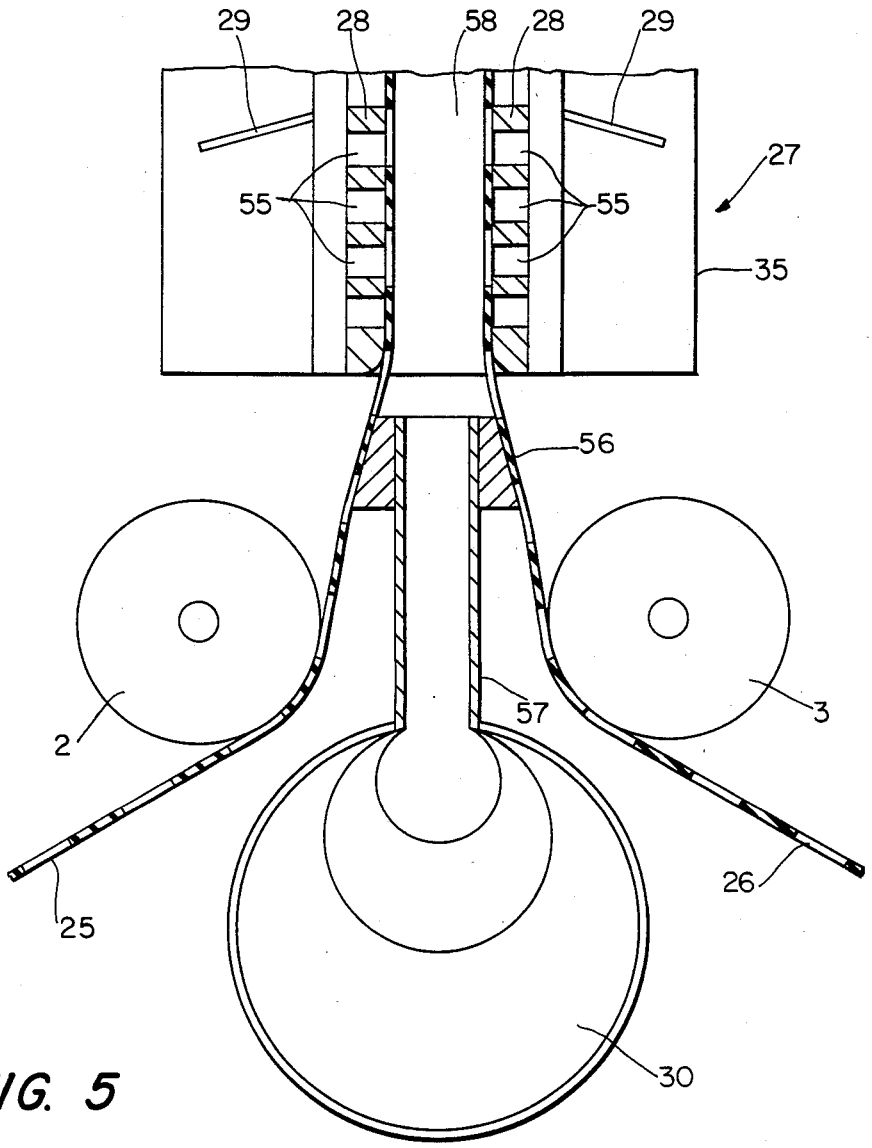
Figure 6:
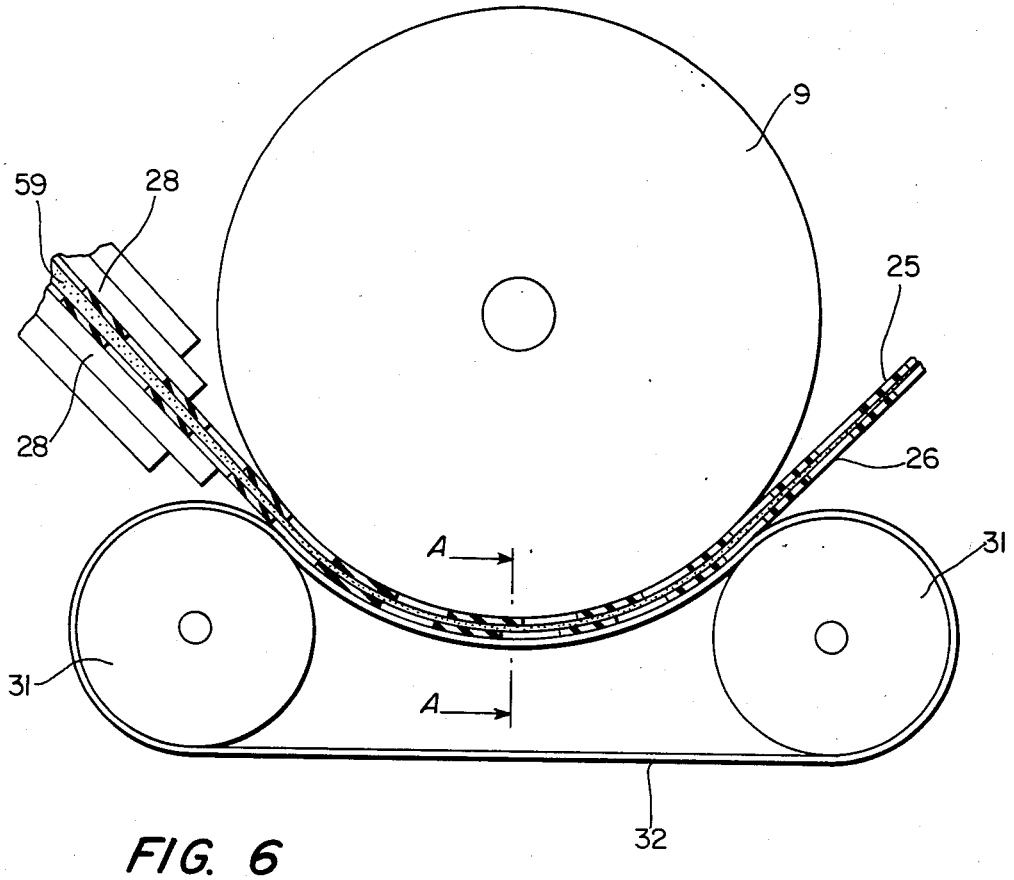
Figure 7:
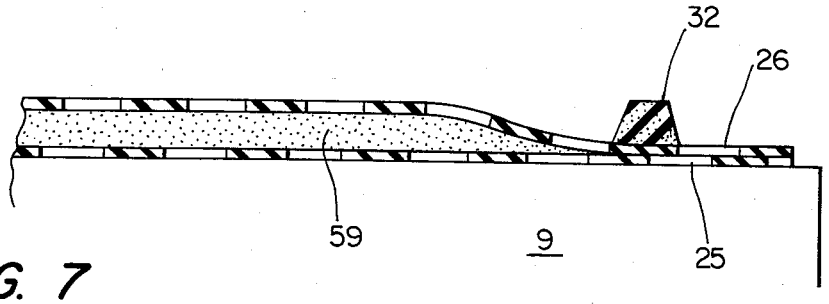

The invention will be further illustrated by reference to the accompanying drawings, in which:

FIGS. 1 through 4 are schematic views in elevation of the dehydration machine with different wedging and pressing sections, FIG. 5 shows the material feed, FIG. 6 shows the lateral sealing in the reversing region, and FIG. 7 is a cross-section taken on line A—A of FIG. 6.

FIG. 1 is a schematic view in elevation of a compact dehydration machine. A number of rolls acting as drive, reversing and tensioning rolls are mounted in the framework 1. A reversing roller 2 is mounted in lowermost manner in the area of the cross-spreader, and another reversing roll acts as a tensioning roll 4, while a regulating roll 5 and the drive roll 7 are located in the upper straining region. The lower straining region also includes a reversing roll 3 in the vicinity of the cross-spreader, a drive roll 8 and a further regulation and tensioning roll 6. The upper strainer 25 is tensioned around the upper rolls 2 through 7, the lower strainer belt 26 being guided around the lower rolls 3, 6, 8. The wedging section 27 and the pressing section 60 as well as a frame segment 13 to which bearing blocks 14 are mounted both laterally and on top to receive the reversing roll 9 and the pressing roll 11, respectively, are all centrally located in the approximately square framework 1. The pressing roll 11 supported in a spatially fixed manner and a movable roll 10 next to the roll 11 are located in the pressing section 60. A movably supported pressing roll 12 is located above the pressing roll 11. The pressing roll 10 is supported in a pressing lever 15 which can move about the pivot bearing 20. An air bellows 17 is provided at the opposite side of the compression exerted by the roll 10, and this bellows 17 in turn rests on a setting lever 16. The setting lever 16 is rotatably mounted by the pivot bearings 19 at the top side of the framework 1. By means of this setting system 18, which might be a setting piston, it is possible to swing out the setting lever 16. The pressing roll 12 also is movably supported in the pressing lever 21 which is mounted by the pivot bearing 22 on the framework 1. A large air bellows 23 is located at the other end of the pressing lever 21, and underneath it a small air bellows 24. In this manner, a high pressure can be exerted on the pressing roll 12, while the smaller one acts as a relief.

A wedging section 27 is provided to receive the material to be dehydrated. It includes a wedge guide means 28 in the form of a tapering track. The wedge angle is in the range from 1° to 6°. The wedge guide means 28 is rectangular in cross-section and closed on the sides. The resting surface of the wedge guide means also includes openings which will be discussed further below.

Stiffening strips 29 are mounted on both sides of the wedge guide 28 and laterally project in such a manner as to simultaneously act as water drains. The entire wedging section 27 is enclosed by a housing 35. The wedging section 27 is provided at its end with a reversing roll 9 about which the stiffening strips pass while acting as water drains. To prevent a sideways escape of the filter cake in the area of the reversing roll 9, additional means are provided at both lateral ends of the strainer track to form a compact closure. This is implemented by providing pulleys 31 looped by the V-belts 32, in this manner resting by one taut side against the strainer belt 25. Thus, the filter cake in between cannot laterally escape.

The water collected by the stiffening strips 29 is drained in a collecting pipe 34. Further drain channels 33 are mounted in front of the pressing rolls 10 and 12 and also are connected to the collecting pipe 34.

When, by means of pumps, a suspension is pressurized and moved into the cross spreader 30 located at the entry of the wedging section 27, then the wedging section is thereupon uniformly loaded and dehydration begins already before the wedging section. Because of the gradual reduction in the spacing of the wedge guide 28, the material is squeezed until it can be moved as a moist band between the two strainer belts 25, 26 around the reversing roll 9. Beyond the reversing system provided with the closure means, the material is guided into the pressing section 60 proper. The first pressing roll 10 performs areal compression and in combination with the adjoining pressing roller 11, a linear compression takes place, the pressure during the transition from one roll to the other being maintained by the strainer tension and the material arriving in the further pair of rolls 11, 12. From there the filter material is moved in the direction of the drive and reversing rolls 7, 8 and is externally discharged. The special design of the pressing rolls 10, 12 makes it possible firstly to set areal and linear compression in case the pressing roll 10 does not contact the pressing roll 11. However, the setting system also allows establishing at any time a pressing nip between the pairs of rolls 10 and 11. Selectively fluted or smooth rolls may be used.

This arrangement of the pressing section 60 and of the wedging section 27 is especially suited for dehydrating pulp, which is easily dehydrated. The band of fibrous material in fact can be relatively thick and can be moved when in the weight range of 600 to 2,000 g/m$^2$.

Figure 2:
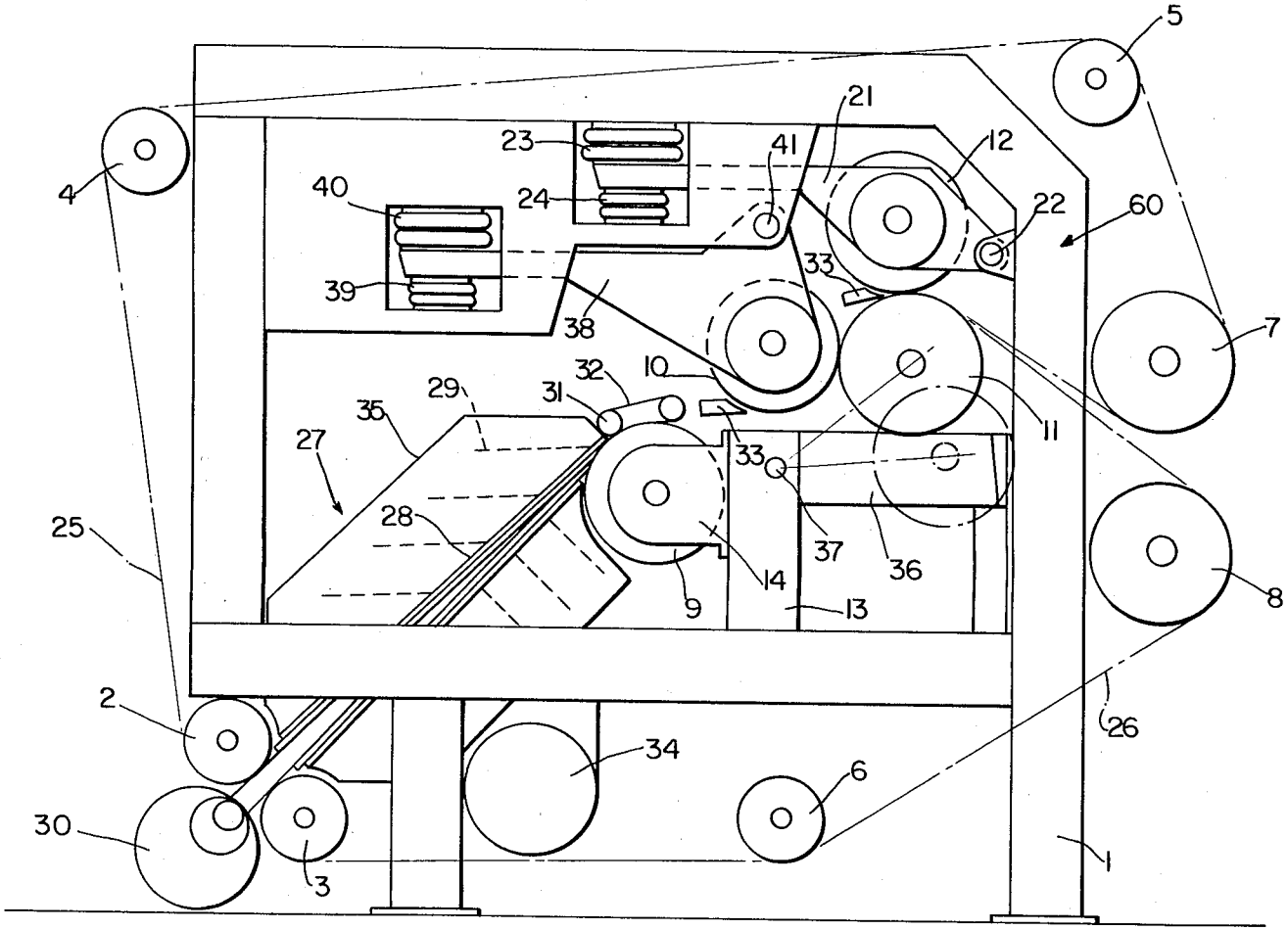

FIG. 2 similarly shows a dehydration machine as already described above but in this case permitting a lower construction height because of the shallower wedging angle. Again, a number of rolls are mounted in the framework 1 and these rolls are denoted by the same reference numerals as in FIG. 1. Again, the cross-spreader 30 is followed by the wedging section 27, which however is no longer substantially vertical, but preferably at an angle of 45°. Again, the reversing roll 9 is kept in the area of the wedging section, care being taken that the two lateral ends of the strainer tracks 25, 26 are laterally sealed by the V-belts 32. The pressing section 60 contains the adjoining two pressing rolls 10, 11, with the pressing roll 11 in this case being rigidly supported on the pivot frame 36 by a bearing block, not shown. The pivot frame 36 can be swung out downwardly about the center of rotation 37, and is used to facilitate exchanging of the strainers. The pressing rolls 10 and 12 rest by means of the pressing levers 38, 21 on the pivot bearings 41, 22. The air bellows 39, 40 and 23, 24 assure compression or return to the initial position.

FIG. 3 shows a further embodiment of the dehydration machine which is suitable especially for materials offering resistance to dehydration, for instance when dehydrating wood pulp or old paper. As is known, these dehydration media require longer pre-dehydration, and this is accounted for in the machine discussed below.

As already mentioned above, various reversing rolls 2–8 are mounted on the framework 1. These rolls are looped by the strainer belts 25, 26. The difference with respect to the previous Figures is that the wedging section 27 is mounted substantially vertically or slightly inclined from the cross-spreader 30, but furthermore in this case it extends completely from the bottom to the top, that is, it is longer than the others. Again, the wedging section 28 is mounted in the housing 35 and again it includes stiffening strips 29 at the outside thereof. These stiffening strips are so designed that they simultaneously act as drains during the dehydration. The pressed-out water is drained through the water pipe 34. The reversing roll 9 is mounted at the end of the wedging section 27 and somewhat enters this section. The bearing block 42 is mounted on the frame part 13 and supports the reversing roll 9. Obviously in this case also the reversing part of the reversing roll 9 is laterally sealed by means of the V-belts 32. Thereafter, the strainer belts are made to pass into the pressing section 60.

The framework 1 furthermore includes the pressing roll bearing in the frame part 13. As the strainer belts 25, 26 move on, they arrive at the first pressing roll 10 which is supported in a pivot beam 43 with pivot bearing 46. A large air bellows 44 is mounted on one side of the pivot beam 43 and implements the compression of the pressing roll 10. A smaller air bellows 45 is mounted opposite and acts to relieve the pressing roll 10. The next pressing roll 11 is mounted in a pressing lever 47 which is supported by means of the pivot bearing 49 in the frame. An abutment 48 is provided to rigidly stop the pressing lever in the framework 1. Lastly, the pressing section 60 includes the last pressing roll 12 which is also supported in a pivot beam 50 and which rests by means of the pivot bearing 52 on the air bellows 51. These three pressing rolls 10, 11, 12 can be selectively set for areal pressing with subsequent linear pressing. However, these three rolls also can be used to perform two linear pressings.

FIG. 4 shows another embodiment of a dehydration machine making use of gravity for the dehydration. In this case, the wedging section 27 is advantageously inverted and guides the material to be dehydrated from top to bottom approximately vertically or at a slight incline. In this case there is no need for a cross-spreader, rather an ordinary material feed 53 receiving the suspension through the hook-up 54 from a pump means is sufficient. The machine itself comprises a similar framework 1, in this case however the reversing rolls 2 and 3 are mounted at the top side of the material feed. Viewed clockwise, the tensioning roll 5 is provided for the top strainer 25 and the drive is again implemented by the drive roll 7. The lower strainer belt 26 passes from the drive roll 8 over the rolls 6, 4, and 2. The wedging section 27 is mounted in the housing 35. Again, the wedge guide 28 is provided with stiffening strips 29 which act as drains. The water drain 34 removes the pressed-out water from the machine. The reversing roll 9 is mounted at the end of the wedging section 27, the lateral sealing for the strainers 25, 26 being performed in this region by means of the V-belts 32 moving on the pulleys 31. Again, the pressing section is composed of three pressing rolls 10, 11, 12. The first two pressing rolls 10 and 11 are approximately adjoining, while the pressing roll 12 is located above the pressing roll 11. The first pressing roll 10 is supported in the pressing lever 38 which can move about the pivot bearing 41. A small air bellows 39 acts on the end of the pressing lever 38 and relieves the pressing roll 10, while a larger air bellows 40, assuring pressing, is mounted opposite. A center of rotation 37 is provided at the frame part 13 and supports a pivot frame 36. A bearing block, omitted from this Figure and rotatably supporting the pressing roll 11, lies against this pivot frame 36. The pivot frame 36 allows the downwardly swinging out of the pressing roll 11 to exchange the strainer belt. The pressing roll 12, which in this case is above, also rests in a pressing lever 21 which is supported by its forward pivot bearing 22 in the framework 1. The pressing lever 21 is provided at its other end with two air bellows, the smaller air bellows 24 acting for the relief and the large air bellows 23 for the compression of the pressing roller 12. In this case also, it is possible to guide the two strainer belts 25, 26 over an areal pressing means with ensuing linear pressing, with areal pressing by the pressing rolls 11 and 12 taking place depending upon the lever position of the pressing lever 38. Dehydration drains 33 assure evacuation of the pressed-out water.

FIG. 5 is an enlargement of the cross-section of the cross-spreader 30 with feed 57. From there the suspension 58 is moved into the wedging section 27. This wedging section contains the wedge guide means 28 interrupted by the openings 55. Again stiffening strips 29 are shown beyond these wedge guides and acting as dehydration drains. The wedging section 27 is enclosed by a housing 35. The two strainer belts 25, 26 in this case pass over the reversing rolls 2, 3 and arrive at the wedging section 27, a slide piece 56 furthermore being mounted at the ends of the feed 57 to assure lateral closure. Advantageously, the two strainer belts 25, 26 will be tensioned to rest against the slide piece 56.

FIG. 6 is an enlargement of the lateral sealing for the two strainer belts 25, 26 in the area of the reversing roll 9 shown in FIG. 4. The two strainer belts 25, 26 issue from the wedging section 27 by departing from the two wedge guide means 28. Directly beyond, one taut side of the V-belt 32 rests against the strainer belt 26 which is guided over the belt pulleys 31. The lateral sealing thus represented assures maintaining the pressure produced in the wedging section over the area of the reversal.

FIG. 7 shows the section A—A of FIG. 6, and merely illustrates that the strainer belt 25 rests on the roll 9, with the suspension 59 in between, the strainer belt 26 being located above as the cover sieve 26. Part of the V-belt 32 is pressed on both strainer belts on the side, so that a material seal is achieved.

Due to this design of the dehydration machine with its approximately vertical or slightly inclined position of the wedging section 27, which is laterally closed, discharging of the suspension is effectively prevented in this region. Because the dehydration is not yet complete at the end of the wedging section, it is necessary to prevent lateral discharge also in the area of reversal. This is implemented in that use is made of the compression by the V-belts 32. Lastly, using only three pressing rollers, it is possible to achieve good dehydration in the wedging section 60, either one areal pressing with subsequent linear pressing or two linear pressings being set depending on application. If necessary, only two rolls can be put into operation, whereby only areal pressing will result. This machine design is inherently compact and entails lower investment costs, and expensive vacuum equipment is not required.

| Listing of reference numerals: | |
|---|---|
| 1 Framework | 32 V-belt |
| 2 Reversing rolls, material feed | 33 Dehydration drains |
| 3 Reversing rolls, material feed | 34 Water evacuation collection pipe |
| 4 Tensioning roll | 35 Housing |
| 5 Reversing roll | 36 Pivot frame |
| 6 Tensioning roll | 37 Center of rotation |
| 7 Drive roll | 38 Pressing lever |
| 8 Drive roll | 39 Small air bellows |
| 9 Reversing roll | |

-continued

| Listing of reference numerals: | |
|---|---|
| 10 Pressing roll | 40 Large air bellows |
| 11 Pressing roll | 41 Pivot bearing |
| 12 Pressing roll | 42 Bearing block |
| 13 Frame part | 43 Pivot beam |
| 14 Bearing block | 44 Large air bellows |
| 15 Pressing lever | 45 Small air bellows |
| 16 Setting lever | 46 Pivot bearing |
| 17 Air bellows | 47 Pressing lever |
| 18 Setting system | 48 Feed |
| 19 Pivot bearing | 49 Pivot bearing |
| 20 Pivot bearing | 50 Pivot beam |
| 21 Pressing lever | 51 Air bellows |
| 22 Pivot bearing | 52 Pivot bearing |
| 23 Large air bellows | 53 Material feed |
| 24 Small air bellows | 54 Hook-up |
| 25 Top strainer | 55 Openings |
| 26 Bottom strainer | 56 Slide piece |
| 27 Wedging section | 57 Supply pipe |
| 28 Wedge guide means | 58 Lateral seal |
| 29 Stiffening strip | 59 Suspension |
| 30 Cross spreader | 60 Pressing section. |
| 31 Pulley | |

It will be obvious to those skilled in the art that many modifications may be made within the scope of the present invention without departing from the spirit thereof, and the invention includes all such modifications.

What we claim is:

1. In a dehydration machine for pulp, sludges or similar fibrous material, composed of a lower sieve acting as a support sieve and of an upper sieve operating as a cover sieve, which sieves revolve about support and reversing rolls and are guided jointly through a wedging section arranged vertically or inclined at an acute angle and leading from the bottom to the top, with subsequent reversal of the sieve belts and of pairs of rolls through which is passed the material to be dehydrated coming from a material feed, the improvement wherein said wedging section is formed as a laterally closed support surface as a guide means and, followed directly by a reversal means provided with a lateral seal, and followed by a pressing section provided with a group of rolls comprising first and second pressing rolls arranged next to one another with a third pressing roll mounted above and in contact with said second pressing roll, and including a pressing system for the first pressing roll which selectively makes possible areal pressing from the first pressing roll with an ensuing pressing nip at the second and third pressing rolls, or two linear pressings, one at the first and second pressing rolls, the other at the second and third pressing rolls.

2. The improvement according to claim 1, in which the wedging section guide means is provided with openings and stiffening strips at the outside of said guide means, which strips act as drains.

3. The improvement according to claim 1, in which the reversal means lateral sealing is implemented by a pair of V-belts revolving in belt pulleys.

4. The improvement according to claim 1, in which the material feed means comprises a cross-spreader which includes a slide-piece, with the lower and upper sieves abutting said slide-piece under pre-tension.

5. The improvement according to claim 2, wherein some of said stiffening strips pass about the reversal means.

* * * * *